US007846634B2

(12) United States Patent
Urabe et al.

(10) Patent No.: US 7,846,634 B2
(45) **Date of Patent: *Dec. 7, 2010**

(54) DEVELOPING AGENT

(76) Inventors: Takashi Urabe, 2-17-2, Higashigotanda, Shinagawa-ku, Tokyo (JP) 141-8664; Satoshi Araki, 2-17-2, Higashigotanda, Shinagawa-ku, Tokyo (JP) 141-8664; Takayasu Aoki, 2-17-2, Higashigotanda, Shinagawa-ku, Tokyo (JP) 141-8664; Tsuyoshi Ito, 2-17-2, Higashigotanda, Shinagawa-ku, Tokyo (JP) 141-8664; Yasuhito Noda, 2-17-2, Higashigotanda, Shinagawa-ku, Tokyo (JP) 141-8664; Motonari Udo, 2-17-2, Higashigotanda, Shinagawa-ku, Tokyo (JP) 141-8664; Masahiro Ikuta, 2-17-2, Higashigotanda, Shinagawa-ku, Tokyo (JP) 141-8664; Takafumi Hara, 2-17-2, Higashigotanda, Shinagawa-ku, Tokyo (JP) 141-8664

( * ) Notice: Subject to any disclaimer, the term of this patent is extended or adjusted under 35 U.S.C. 154(b) by 430 days.

This patent is subject to a terminal disclaimer.

(21) Appl. No.: 11/947,895

(22) Filed: Nov. 30, 2007

(65) Prior Publication Data

US 2008/0131808 A1 Jun. 5, 2008

Related U.S. Application Data

(60) Provisional application No. 60/868,201, filed on Dec. 1, 2006.

(30) Foreign Application Priority Data

Nov. 22, 2007 (JP) ..... 2007-303322

(51) Int. Cl.
*G03G 9/08* (2006.01)

(52) U.S. Cl. ..... 430/110.2; 430/137.19

(58) Field of Classification Search ..... 430/137.19, 430/110.2, 139.19

See application file for complete search history.

(56) References Cited

U.S. PATENT DOCUMENTS

2005/0271965 A1* 12/2005 Kamiyoshi et al. ..... 430/111.4
2007/0281240 A1* 12/2007 Urabe et al. ..... 430/137.14

FOREIGN PATENT DOCUMENTS

JP 09-311502 12/1997
JP 11-311877 11/1999
JP 2007-106906 4/2007

* cited by examiner

*Primary Examiner*—John L Goodrow

(57) ABSTRACT

A developing agent including a toner particle obtained by using a dispersion containing a solvent, a granular mixed compound having a binder resin and a coloring agent dispersed in the solvent, and, as an additive to disperse a compound, a combination of a surfactant and a basic compound or a combination of a sulfone-based surfactant and a polycarboxylic acid-based surfactant, wherein the additive remaining in the developing agent is within a predetermine range.

18 Claims, 2 Drawing Sheets

DEVELOPING AGENT

CROSS-REFERENCE TO RELATED APPLICATIONS

This application claims the benefit of U.S. Provisional Application No. 60/868,201, filed Dec. 1, 2006.

This application is based upon and claims the benefit of priority from prior Japanese Patent Application No. 2007-303322, filed Nov. 22, 2007, the entire contents of which are incorporated herein by reference.

BACKGROUND OF THE INVENTION

1. Field of the Invention

The present invention relates to a developing agent used to develop an electrostatic charge image and a magnetic latent image in electrophotography, electrostatic printing, magnetography, etc.

2. Description of the Background

In electrophotography, an electric latent image is formed on an electrostatic latent image carrier, developed using a toner to be transferred as a toner image to a transfer material such as paper or the like, and fixed by heating and pressing. With respect to the used toner, not only a past toner of monochromatic black but also a plurality of toners with different colors are used to form an image in a full range of colors.

A toner includes a second-ingredient developing agent used by blending with a carrier particle and a first-ingredient developing agent used as a magnetic or non-magnetic toner. The toner is generally prepared by a melting pulverization method. The melting pulverization method produces a toner particle by melting-mixing a binder resin, a pigment, a mold releasing agent such as wax, a charge controller or the like, cooling down and pulverizing finely, and distributing. An inorganic and/or organic fine particle may be deposited on the surface of the toner particle prepared by the mixing pulverization method as necessary.

The toner particle prepared by the mixing pulverization method generally has an indeterminate shape and a nonuniform composition on the surface. The shape or the surficial composition of the toner particle may vary delicately depending on pulverizing properties of a material or pulverizing conditions, but it is not simple to intentionally control the shape. Further, in the case of a material with high pulverizing properties, the toner particle is pulverized even finely or changed in the shape due to stresses in a developing device. Also, as for the second-ingredient developing agent, a pulverized toner particle sticks to the surface of the carrier so that the developing agent accelerates in charge deterioration. As for the first-ingredient developing agent, the distribution of particles expands so that the pulverized toner particles are scattered or the shape of the toner is changed to lower its developing properties, thereby causing deterioration of image quality.

Meanwhile, in the case of a toner having a mold releasing agent such as wax or the like internally added, pulverization can easily occur on the interface between a binder resin and the mold releasing agent, and thus the mold releasing agent may be exposed on the surface of a toner particle. In particular, when a toner is made of a high elastic resin hard to be pulverized and soft wax such as polyethylene, polyethylene is exposed a lot on the surface of a toner particle. Such a toner is favorable in mold releasing properties or for cleaning an untransferred toner in fixing. However, polyethylene on the surface of the toner particle is separated from the toner particle due to mechanical power such as shearing power or the like in a developing device to easily transfer to a developing roll, a photosensitive body, a carrier, or the like so that they are liable to be contaminated. Thus, such a toner is less reliable for a developing agent.

In consideration of the foregoing problem, JP Patent Publications No. S63-282752 and No. H06-250439, for example, disclose an emulsion polymerization and coagulation method proposed as a production method of a toner where the shape and the surficial composition of a toner particle are intentionally controlled.

In the emulsion polymerization and coagulation method, a resin dispersion prepared by an emulsion polymerization method and a coloring agent dispersion where a coloring agent is disposed in a solvent are mixed to form a coagulated particle corresponding to a toner particle size and fused by heating to obtain a toner particle. According to the emulsion polymerization and coagulation method, the toner may have different shapes from indeterminate to spherical by controlling a heating temperature.

Further, it is tried that the distribution of molecular weight is intentionally controlled in order to improve a fixing property. As a resin with low molecular weight emulsified at low temperature, it can be fixed on a paper with low energy. However, since the resin has low viscoelasticity, an offset phenomenon occurs over a certain level of energy. As a decline of the viscoelasticity at high temperature is eased by using with a resin having high molecular weight, the temperature where an offset phenomenon occurs expands to high temperature. Thus, a mixture of a plurality of resins with different molecular weights or a resin having a plurality of molecular weights by intentionally controlling the distribution of molecular weight of one resin may be used in the method.

In the emulsion polymerization and coagulation method, a toner particle can be obtained by coagulating and fusing at least a fine resin grain dispersion and a coloring agent dispersion. According to the emulsion polymerization and coagulation method, the toner may have various shapes from indeterminate to spherical by controlling a heating temperature.

There is a phase inversion emulsification method where a pigment dispersion or the like is added to a solution containing an organic solvent and water is added thereto.

Further, JP Patent Publication No. H09-311502 discloses a production method of a fine particle by mechanical shearing in an aqueous medium without using an organic solvent.

However, if an additive such as a surfactant or the like adopted for the methods remains in a developing agent over a predetermined amount, it has an ill effect upon charge characteristics.

BRIEF SUMMARY OF THE INVENTION

The present invention has been made in light of these considerations. The object of the invention is to provide a developing agent which has satisfactory fixing properties and charge stability.

According to an aspect of the invention, a developing agent includes a toner particle containing a fine particle obtained by carrying out mechanical shearing on a dispersion including at least one of an aqueous medium, a granular mixed compound of a binder resin and a coloring agent dispersed in the aqueous medium, and at least one of a surfactant and a basic compound, wherein the content of the remaining basic is from 0 to 1% by weight and the content of the remaining surfactant is from 0 to 2% by weight relative to the total amount of the developing agent.

According to another aspect of the invention, a developing agent includes a toner particle obtained by using a dispersion including a solvent, a granular mixed compound of a binder resin and a coloring agent dispersed in the solvent, a sulfone-based surfactant, and a polycarboxylic acid-based surfactant, wherein the content of the remaining sulfone-based surfactant is from 0 to 0.5% by weight and the content of the remaining polycarboxylic acid-based surfactant is from 0.1 to 5% by weight relative to the total weight of the toner particle.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate embodiments of the invention, and together with the general description given above and the detailed description of the embodiments given below, serve to explain the principles of the invention.

DETAILED DESCRIPTION OF THE INVENTION

Figure 1:
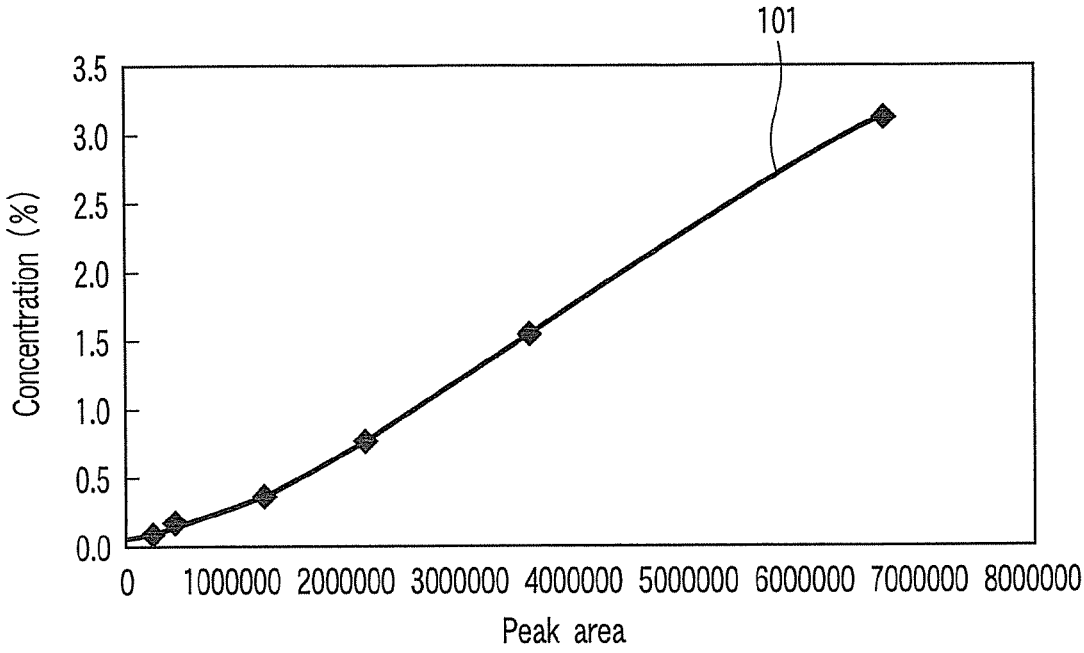
FIG. 1 is a graph illustrating an example of a calibration curve to detect the amount of the remaining surfactant.

A developing agent according to the invention includes a toner particle obtained by using a dispersion including a solvent, a granular mixed compound containing a binder resin and a coloring agent dispersed in the solvent, and an additive to disperse the mixed compound, wherein the amount of the additive remaining in the developing agent is within a predetermined range.

A developing agent according to a first embodiment of the invention uses a toner particle including a fine particle obtained by mixing at least one of a surfactant and a basic compound with a granular mixed compound containing a binder resin and a coloring agent and an aqueous medium, and mechanically shearing the mixture.

The developing agent has an acid value of 1 to 30 mgKOH/g and contains a 0 to 1% by weight of the remaining basic compound and 0 to 2% by weight of the remaining surfactant relative to its whole amount.

According to the first embodiment of the invention, a satisfactory fixing property and transfer efficiency can be promoted by regulating the acid value of the resin contained in the developing agent, the amount of the surfactant, and the amount of the basic compound, thereby giving excellent charge characteristics of a toner regardless of the environmental atmosphere and reducing the quantity of a toner inversely charged with respect to the distribution of the charge quantity. As a result, an image with less fog can be obtained.

If the amount of the remaining basic compound is more than 1% by weight relative to the total amount of the developing agent, charge distribution becomes nonuniform so that a toner with opposite charge tends to increase. If the amount of the remaining surfactant is more than 2% by weight relative to the total amount of the developing agent, the charge quantity tends to be changed considerably by the environmental atmosphere.

A developing agent according to a second embodiment of the invention includes a toner particle obtained by using a dispersion including a solvent, a granular mixed compound of a binder resin and a coloring agent dispersed in the solvent, and at least one of a sulfone-based surfactant and a polycarboxylic acid-based surfactant, wherein the content of the remaining sulfone-based surfactant is from 0 to 0.5% by weight and the content of the remaining polycarboxylic acid-based surfactant is from 0.1 to 5% by weight relative to the total weight of the toner particle.

According to the invention, by regulating the amount of the sulfone-based surfactant and the amount of the polycarboxylic acid-based surfactant, bad effects of the remaining sulfone-based dispersant on charge characteristics is controlled by the remaining polycarboxylic acid-based surfactant so that a toner particle with satisfactory charge characteristics can be produced regardless of the environmental atmosphere. Accordingly, a developing agent representing excellent image quality and high transfer efficiency can be obtained.

If the amount of the sulfone-based surfactant is more than 0.5% by weight relative to the total weight of the toner particle, the charge quantity is remarkably reduced and considerably changed on the environmental change.

If the amount of the polycarboxylic acid-based surfactant is less than 0.1% by weight on the total weight of the toner particle, the effects of the trace amount of the sulfone-based surfactant remaining in the toner on the charge characteristics becomes prominent so that the charge quantity is changed considerably on the environmental change, as well as in the case where the amount of the sulfone-based surfactant is more than 0.5% by weight. If it is more than 5% by weight, a coarse powder is increased to cause deterioration of image quality.

In the first and second embodiments, the granular mixed compound containing the binder resin and the coloring agent, for example, includes a particle containing a mixture of a binder resin and a coloring agent or a mixture of a binder resin particle and a coloring agent particle.

In the first and second embodiments, the particle containing the mixture of the binder resin and the coloring agent, for example, includes a pulverized particle obtained by pulverizing a kneaded mixture containing a binder resin and a coloring agent, and the toner particle includes a fine particle obtained by mechanically shearing a dispersion containing an aqueous medium, a pulverized particle dispersed in the aqueous medium, a sulfonic surfactant, and a polycarboxylic acid surfactant.

In the second embodiment, the granular mixed compound containing the mixture of the binder resin particle and the coloring agent particle is dispersed in a solvent, and the toner particle includes a coagulated particle obtained by coagulating a fine particle in a dispersion containing the fine particle such as a binder resin particle and a coloring agent particle, a sulfonic surfactant, a polycarboxylic acid surfactant, and a solvent.

As the solvent, in addition to an aqueous medium, aromatic solvents such as toluene and xylene; aliphatic hydrocarbon solvents such as hexane and heptane; ester based solvents such as ethyl acrylate and butyl acrylate; ketone based solvents such as acetone, methyl ethyl ketone, and methyl isobutyl ketone; alcohol based solvents such as methanol, ethanol, and 2-propanol; and a mixture thereof can be used.

The granular mixed compound may further at least one of wax and a charge controller.

The wax and the charge controller are mixed with the kneaded mixture and pulverized, or dispersed in the aqueous medium to form a wax particle and a charge controller particle and the particles are mixed with the binder resin particle and the coloring agent particle.

As the binder resin, styrene based resins such as polystyrene, styrene-butadiene copolymers, and styrene-acrylate copolymers; ethylene based resins such as polyethylene, poly (ethylene-vinyl acetate) copolymers, polyethylene-norbornene copolymers, and polyethylene-vinyl alcohol copolymers; polyester resins; acrylic resin; phenolic resins; epoxy resins; aryl phthalate resins; polyamide resins; maleic acid based resins; and the like are used singly or in combination of two or more kinds.

As the coloring agent, carbon black, organic or inorganic pigments, or organic or inorganic dyes are used.

In particular, carbon black, acetylene black, furnace black, thermal black, channel black, ketjen black or the like is used as a black coloring agent.

C.I. pigment yellow 1, 2, 3, 4, 5, 6, 7, 10, 11, 12, 13, 14, 15, 16, 17, 23, 65, 73, 74, 81, 83, 93, 95, 97, 98, 109, 117, 120, 137, 138, 139, 147, 151, 154, 167, 173, 180, 181, 183, and 185, C.I. bat yellow 1, 3, and 20, or the like is used as a yellow pigment singly or in combination of plural kinds thereof.

C.I. pigment red 1, 2, 3, 4, 5, 6, 7, 8, 9, 10, 11, 12, 13, 14, 15, 16, 17, 18, 19, 21, 22, 23, 30, 31, 32, 37, 38, 39, 40, 41, 48, 49, 50, 51, 52, 53, 54, 55, 57, 58, 60, 63, 64, 68, 81, 83, 87, 88, 89, 90, 112, 114, 122, 123, 146, 150, 163, 184, 185, 202, 206, 207, 209, and 238, C. I. pigment violet 19, C.I. bat red 1, 2, 10, 13, 15, 23, 29, and 35, or the like is used as a magenta pigment single or in combination of plural kind thereof.

C.I. pigment blue, 2, 3, 15, 16, and 17, C. I. bat blue 6, C.I. acid blue 45, or the like is used singly or in combination as a cyan pigment.

As the surfactant used for the first embodiment of the invention, an anionic surfactant such as sulfuric acid esters, sulfonates, phosphoric esters, soaps, and the like; a cationic surfactant such as amine salts, quaternary ammonium salts, and the like; and a nonionic surfactant such as polyethylene glycols, alkylphenol ethylene oxide adducts and polyhydric alcohols can be used.

The basic compound, not limited as long as it is adjusted to have a desired pH, is desirably a amine compound, e.g., dimethylamine, trimethylamine, monoethylamine, diethylamine, triethylamine, propylamine, isopropylamine, dipropylamine, butylamine, isobutylamine, sec-butylamine, monoethanolamine, diethanolamine, triethanolamine, triisopropanolamine, isopropanolamine, dimethylethanolamine, diethylethanolamine, N-butyldiethanol amine, N,N-dimethyl-1,3-diaminopropane, N,N-diethyl-1,3-diaminopropane, and the like.

The sulfonic surfactant used for the second embodiment of the invention is at least one selected from the group consisting of alkyl sulphate, alkyl benzene sulfonate, alkyl naphthalene sulfonate, alkyl diphenyl disulfonate, alkyl diphenyl ether disulfonate, polyoxylene adduct alkyl sulphate, dialkyl sulfosuccinate, naphthaline sulfonate formalin condensate, phenolsulfonic acid formalin condensate, and polystyrene sulfonate.

The polycarboxylic acid surfactant used for the second embodiment of the invention is at least one selected from the group consisting of polyacrylate, copolymer salt of α-olefin and maleic acid, and a copolymer of acrylate and ester.

As the aqueous medium, ion exchange water and refined water can be used.

As the charge controller, a metal-containing azo compound is used, wherein a complex, a complex salt, or a mixture of iron, cobalt, and chrome is desirable. Further, a metal-containing salicylic acid derivative is used, wherein a complex, a complex salt, or a mixture of zirconium, zinc, chrome, and boron is desirable.

The wax to be used in the invention include, for example, aliphatic hydrocarbon waxes such as low molecular polyethylene, low molecular polypropylene, polyolefin copolymers, polyolefin wax, microcrystalline wax, paraffin wax, and Fischer-Tropsch wax; vegetable waxes such as candelilla wax, carnauba wax, haze wax, jojoba wax, and rice wax; animal waxes such as beewax, lanolin, and spermaceti; mineral waxes such as ozocerite, ceresin wax, and petrolactam; aliphatic ester based waxes such as montanic acid ester wax and castor wax; and partially or fully deoxidized aliphatic esters such as deoxidized carnauba wax. Furthermore, it includes saturated straight-chain fatty acids such as palmitic acid, stearic acid, montanonic acid, and long-chain alkyl carboxylic acids having a long-chain alkyl group; unsaturated fatty acids such as brassidic acid, eleostearic acid, and varinaline acid; saturated alcohols such as stearyl alcohol, eicosyl alcohol, behenyl alcohol, carnaubyl alcohol, ceryl alcohol, melissyl alcohol, or alkyl alcohol having a long-chain alkyl group; polyvalent alcohols such as sorbitol; aliphatic amides such as linoleic amide, oleic amide, and lauric amide; saturated aliphatic bisamides such as methylene bis-stearic amide, ethylene bis-capric amide, ethylene bis-lauric acid, and hexamethylene bis-stearic amide; unsaturated aliphatic amides such as ethylene bis-oleic amide, hexamethylene bis-oleinic amide, N,N'-dioleyl adipinic amide, and N,N'-dioleyl sebacic amide; aromatic bisamides such as m-xylene bis-stearic amide and N,N'-distearyl isophthalic amide; aliphatic metallic salts (generally referred to as metal soap) such as calcium stearate, calcium laurate, zinc stearate, and magnesium stearate; wax obtained by grafting aliphatic hydrocarbon wax using vinyl monomers such as stylene or acrylic acid; a partially esterified product of fatty acid such as monoglyceride behenic acid and polyalcohol; and a methyl ester compound having a hydroxyl group obtained by the hydrogenation of vegetable oil.

The fine particle to be used in the invention desirably has a volume average particle diameter of 0.05 to 10 μm. If it is less than 0.05 μm, the specific surface area of the particle expands so that the viscosity of the dispersion is liable to increase. If it is more than 10 μm, image quality in the reproducibility of a hairline tends to be deteriorated.

Further, the fine particle is even coagulated into a coagulated particle.

The fine particle of the invention can be coagulated by carrying out at least one of pH adjustment, addition of a surfactant, addition of water-soluble metal salt, addition of an organic solvent, and adjustment of temperature.

As a pH adjuster, the foregoing basic compound can be used. Further, the foregoing surfactant can be used as a useful surfactant.

As the water-soluble metal salt, a metal salt such as sodium chloride, calcium chloride, calcium nitrate, barium chloride, magnesium chloride, zinc chloride, magnesium sulfate, aluminum chloride, and aluminum sulfate, an inorganic metal salt polymer such as aluminum polychloride, aluminum polyhydroxide, and calcium polysulfide, and the like can be used.

As the organic solvent, alcohols such as methanol, ethanol, 1-propanol, 2-propanol, 2-methyl-2-propanol, 2-methoxyethanol, 2-ethoxyethanol, and 2-butoxyethanol, acetonitrile, 1,4-dioxane, and the like can be used.

The toner particle of the invention desirably has a volume average particle diameter of 1 to 10 μm.

If it is less than 1 μm, it is not easy to control the charge quantity of the toner particle so that a defective image tends to be formed due to scattering of the toner particles or the like. If it is more than 10 μm, image quality in the reproducibility of a hairline or the like tends to be deteriorated.

The toner particle desirably has a circularity of 0.8 to 1.0.

If it is less than 0.8, transfer efficiency becomes worse so that a defective image tends to be formed.

In the invention, the surface of the toner may be coated with a material containing a resin.

The coating method is not limited but, for example, includes additional mechanical-agitation of the fine particle obtained by mechanical shearing. A coating apparatus includes Hybridizer (manufactured by Nara Machine Manufacturing Co., Ltd.), Cosmos system (manufactured by Kawasaki Heavy Industries, Ltd.), Mechano-Fusion (manufactured by Hosokawa Micron, Ltd.), Mechanomill (manufactured by Okada Seiko Co., Ltd.), etc. To obtain the uniform surface of the coated particle, thermal treatment may be carried out or Surfacing System (manufactured by Nippon Pneumatic Mfg. Co., Ltd.) may suitably be used.

Coating is also carried out by adding an additional fine particle to the dispersion containing the mechanically sheared fine particle and allowing hetero-coagulation. Furthermore, coating is performed by adding a desired monomer to the same dispersion to be absorbed on the fine particle and polymerizing, by hetero-coagulating a grown fine particle from the monomer without being absorbed, or by balancing the foregoing processes.

The additional fine particle desirably has a volume average particle diameter of 0.03 to 1 μm.

If it is less than 0.03 μm, the toner is not coated thick enough and tends to not be coated partially. If it is more than 1 μm, satisfactory tinting strength tends to not be obtained due to a ratio difference between a part containing a pigment and a part not containing a pigment.

As the additional fine particle, the monomer, and the like used for coating, a styrene resin, a polyester resin, an acylic acid ester resin, or a combination thereof can be used.

A mechanical shearing apparatus to be used for the invention, not limited, for example, includes a medialess device such as Ultra-Turrax (manufactured by IKA Japan K.K.), T.K. Auto Homo Mixer (manufactured by PRIMIX Corporation), T.K Pipeline Homo Mixer (manufactured by PRIMIX Corporation), T.K. Filmics (manufactured by PRIMIX Corporation), Clearmix (Mtechnique Co., Ltd.), Clear SS5 (manufactured by Mtechnique Co., Ltd.), Cavitron (manufactured by Eurotech, Ltd), Fine Flow Mill (manufactured by Pacific Machinery & Engineering Co., Ltd.), Microfluidizer (manufactured by Mizuho industrial Co., Ltd.), Altimizer (manufactured by Sugino Machine Ltd.), Nanomizer (manufactured by Yoshida Kikai Kogyo Co., Ltd.), Genus PY (manufactured by Hakusui Kagaku Kogyo Co., Ltd.), and NANO 3000 (manufactured by Mizuho Co., Ltd.); and a media device such as Viscomill (manufactured by Aimex Co., Ltd.), Apex mill (manufactured by Kotobuki Industries Co., Ltd.), Star mill (manufactured by Ashizawa Finetech Ltd.), DCP Superflow (manufactured by Nippon Eirich Co., Ltd.), MP Mill (manufactured by INOUE MFG., INC.), Spike Mill (manufactured by INOUE MFG., INC.), Mighty mill (manufactured by INOUE MFG., INC.), and SC Mill (manufactured by Mitsui Mining Co., Ltd.).

In particular, Nanomizer as a high-pressure shearing device, NANO 3000, and Clear mix using internal shearing force are desirable to simply pulverizing a viscoelastic resin into a fine particle.

According to the invention, a mixture or a kneaded mixture containing at least a resin and a pigment can be heatingly pulverized into a fine particle using the mechanical shearing apparatus.

Mechanical shearing can be carried out at the glass transition temperature of the binder resin or more.

After the pulverization, the mixture is cooled down to a desired temperature or adjusted to a desired temperate when performing coagulation.

The mixture containing at least the resin and the pigment can be kneaded to be used for the invention.

The granular mixed compound to be used in the invention is obtained by melt-kneading the compound containing the binder resin and the coloring agent and coarsely pulverizing.

A kneader, not limited to a specific type as long as it performs melt-kneading, includes a monoaxial extruder, a biaxial extruder, a press-type kneader, a banbury mixer, a brabender mixer, etc. In detail, there are FCM (manufactured by Kobe Steel, Ltd.), NCM (manufactured by Kobe Steel, Ltd.), LCM (manufactured by Kobe Steel, Ltd.), ACM (manufactured by Kobe Steel, Ltd.), KTX (manufactured by Kobe Steel, Ltd.), GT (manufactured by Ikegai, Inc.), PCM (manufactured by Ikegai, Inc.), TEX (manufactured by Nippon Steel Corporation), TEM (manufactured by Toshiba Machine Machinery Co., Ltd.), ZSK (manufactured by Werner & Pfleiderer Corporation), and Kneadex (manufactured by Mitsui Mining Co., Ltd.).

The fine particle, the coagulated particle, or an integrated fused particle as necessary may be washed. In the washing process, the dispersion containing the fine particle obtained by mechanical shearing is repeatedly washed until the waste liquid from washing gives a conductivity of 200 μS/cm or less. As a washing equipment, not limited, for example, a centrifugal separator, a filter press, or the like is suitably used. As a washing solution, water, acid water, or alkaline water are used.

In order to adjust the fluidity or charge characteristic of the toner, 0.01 to 20% by weight of an inorganic fine particle based on the weight of the toner particle is deposited on the surface of the toner particle.

As the inorganic fine particle, silica, titania, alumina, strontium titanic acid, and tin oxide may be used singly or in combination of two or more kinds.

Further, the inorganic fine particle treated with a hydrophobization agent on its surface is desirably used in consideration of improvement of environmental stability. The hydrophobization agent, for example, includes dimethylchlorosilane, monomethylrilchlorosilane, hexamethyldisilazane, aminosilane, and silicon oil.

Besides the inorganic oxide, a resin particle in 1 μm or less is externally added for improving a cleaning property. As the resin particle, a styrene resin, a polyester based resin, an acrylic ester based resin, or a combination thereof can be used.

As a mixer of the inorganic particle, Henschel mixer (manufactured by Mitsui Mining Co., Ltd.), Super mixer (manufactured by Kawata Mfg Co., Ltd.), Libocone (manufactured by Okawara Mfg. Co., Ltd.), Nauta mixer (manufactured by Hosokawa Micron, Ltd.), Turbulizer (manufactured by Hosokawa Micron, Ltd.), Cyclomix (manufactured by Hosokawa Micron, Ltd.), Spiral Pin Mixer (manufactured by Pacific Machinery & Engineering Co., Ltd.), and Lodige Mixer (manufactured by Matsubo Corporation) can be used.

In the invention, a coarse particle may be separated with a sieve. A sieving apparatus includes Ultrasonic (manufactured by Teruyoshi Sangyo Co., Ltd.), Gyroshifter (manufactured by Tokuju Kosaku K.K.), Vibrasonic System (manufactured by Dolton K.K.), Sonicreen (manufactured by Shinto Kogyo K.K.), Turboscreener (manufactured by Turbo Kogyo Co., Ltd.), Microshifter (manufactured by Makino Sangyo Co., Ltd.), and a circular vibrating sieve.

EXAMPLES

Hereinafter, the present invention will be explained in more detail as follows with reference to Examples.

Examples 1-1 to 1-4 illustrate examples of a developing agent according to a first embodiment of the invention, and Comparative Examples 1-1 to 1-4 are their comparisons.

Also, Examples 2-1 to 2-6 illustrate examples of a developing agent according to a second embodiment of the invention, and Comparative Examples 2-1 to 2-5 are their comparisons.

Example 1-1

90 parts by weight of a polyester resin (acid value: 9, glass transition temperature: 61° C.) as a binder resin, 5 parts by weight of a cyan pigment (copper phthalocyanine) as a coloring agent, 4 parts by weight of ester wax, and 1 part by weight of a zirconia metal complex as a charge controller were mixed and then melt-kneaded in a biaxial kneader at 120° C. to obtain a kneaded mixture.

The kneaded mixture was pulverized with a hammermill manufactured by Nara Machine Manufacturing Co., Ltd. to obtain a coarse particle having a volume average particle size of 1.2 mm.

40 parts by weight of the coarse particle, 4 parts by weight of sodium dodecylbenzene sulfonate as an anionic surfactant, 2 parts by weight of triethylamine as an amine compound, and 54 parts by weight of ion exchange water were put into Clearmix manufactured by Mtechnique Co., Ltd.

The dispersion in the Clearmix was heated to 95° C. while being stirred at a low speed, and then mechanically sheared at a rotation speed of 6,000 rpm for 30 minutes. After completion of the mechanical shearing, the dispersion was cooled down to normal temperature.

The obtained coloring particle had a volume average particle diameter of 4.5 μm measured with a coulter counter manufactured by Beckman Coulter, Inc.

The dispersion was centrifuged with a centrifugal separator at a rotation speed of 1,800 rpm to separate the solid part, and then the solid part was washed with ion exchange water while measuring the conductivity of the waste water with ES-51 conductivity meter (manufactured by Horiba, Ltd.). Washing was completed when the conductivity of the waste water was decreased to 197 μS/cm, and the solid part was dried by a decompression drier to produce a toner particle.

Thereafter, as an additive, 2 parts by weight of hydrophobic silica and 0.5 parts by weight of titanium oxide were deposited on the surface of the toner particle to obtain an electrophotographic toner.

The electrophotographic toner had a volume average particle diameter of 4.5 μm when measured with a coulter counter manufactured by Beckman Coulter, Inc. and a circularity of 0.98 when measured with FPIA-2100 manufactured by Sysmex Corporation.

Further, as illustrated in the following, the amount of the surfactant and the basic compound remaining in the electrophotographic toner thus obtained were measured and evaluated.

Method of Measurement of Content of Remaining Surfactant or analysis, high performance liquid chromatography (HPLC) as a measuring method and a photodiode array (PDA) as a detector were used. The analysis was carried out under the following conditions.

HPLC: Alliance 2695 (manufactured by Waters Corporation)

Photodiode Array Detector 2996 (manufactured by Waters Corporation)

Column: Atlantis (manufactured by Waters Corporation)

Column temperature: 40° C.

Mobile phase: purified water and acetonitrile for HPLC

Additive: Sodium perchlorate in mobile phase

Flow Rate: 1 cc/min

Injection Amount: 10 μL

Preparation of Calibration Curve

Five or more samples each adjusted in the amount of a predetermined surfactant were prepared to give a calibration curve.

The obtained curve was shown by graph 101 in FIG. 1.

Method of Measurement 10 g of the electrophotographic toner and 90 g of ion exchange water were mixed and ultrasonically-dispersed for 60 minutes. The obtained dispersion was separated by a centrifugal separator into a solid part and a supernatant. The supernatant was only taken with HPLC to detect sodium dodecylbenzene sulfonate. From the calibration curve, the amount of the remaining surfactant was obtained, which was 1.60% by weight.

Method of Measurement of Content of Remaining Basic Compound

For analysis, gas chromatography as a measuring method and FID or MS as a detector were used in combination. For introducing gas, a head space method can be employed.

Analysis was carried out under the following conditions.

Gas chromatography mass spectrometer: GCMS-QP2010 (manufactured by Shimadzu Corporation)

Headspace Autosampler: HS40 (manufactured by Perkin Elmer, Inc.)

Column: DB-1 (manufactured by Agilent Technologies)

Carrier gas: 99.995% or more helium

Preparation of Calibration Curve

Five or more samples each adjusted in the amount of a predetermined basic compound were prepared to give a calibration curve.

Figure 2:
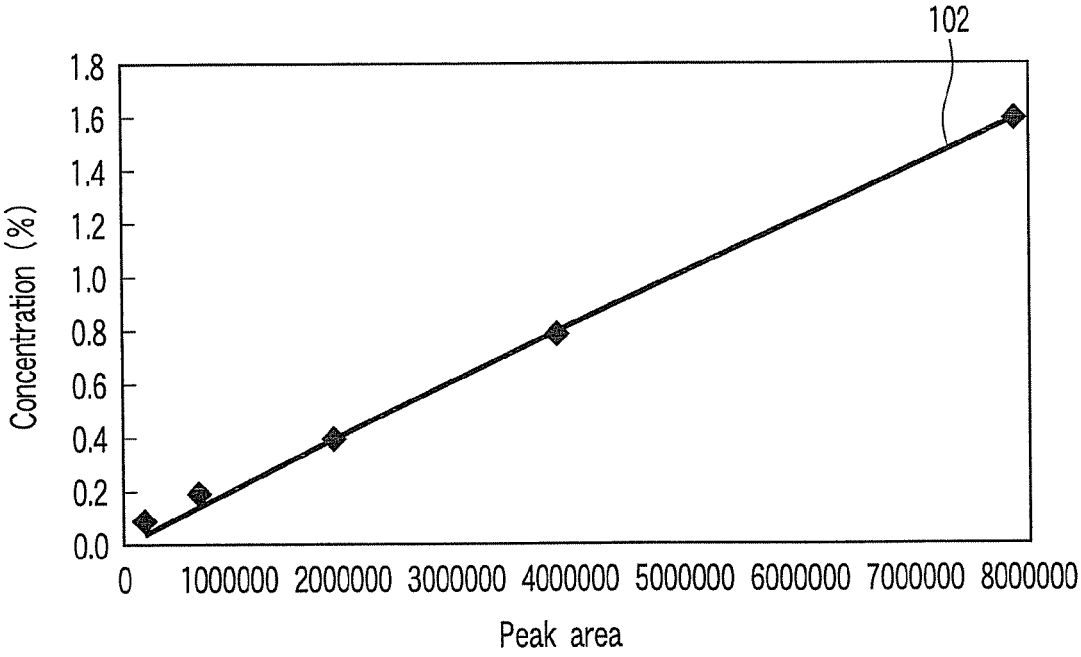
FIG. 2 is a graph illustrating an example of a calibration curve to detect the amount of the remaining basic compound.
Figure 3:
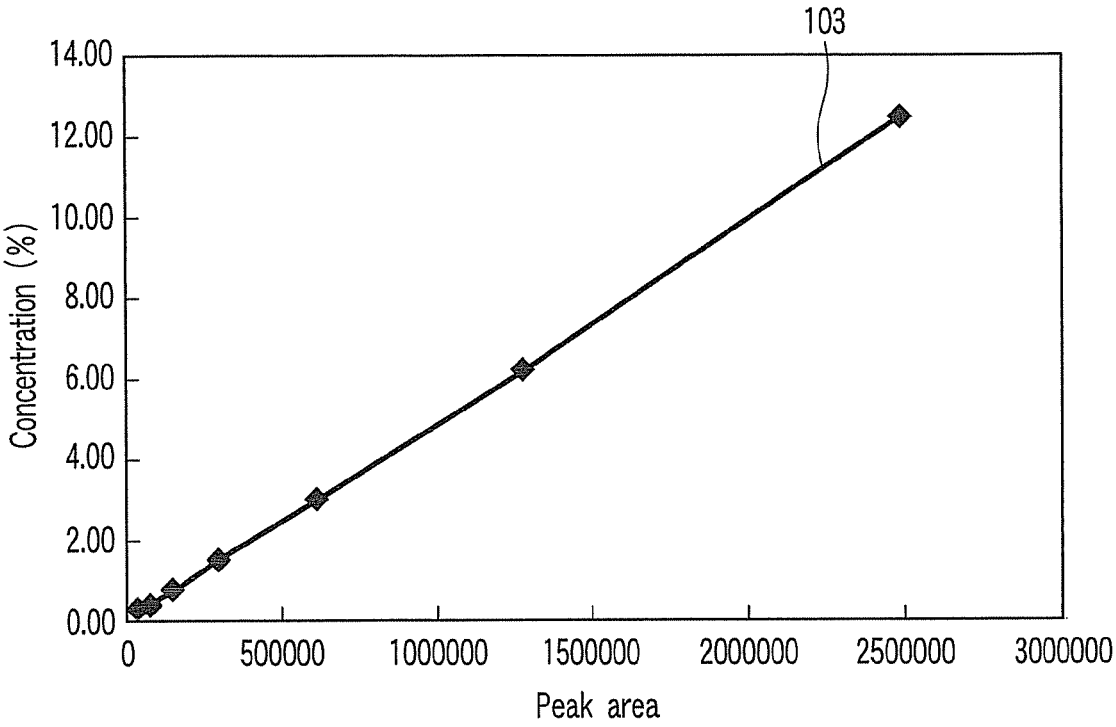
FIG. 3 is a graph illustrating an example of a calibration curve to detect the amount of the remaining sulfone-based surfactant.

The obtained line was shown by graph 102 in FIG. 2.

Method of Measurement of Content of Remaining Basic Compound 0.05 g of the electrophotographic toner was put in a vial and set in a headspace device, and then kept at 90° C. for 30 minutes. Then, triethylamine was detected by gas chromatography. From the calibration curve, the amount of the remaining surfactant was obtained, which was 0.89% by weight.

Evaluation of Environmental Variation Rate

The obtained electrophotographic toner and a ferrite carrier coated with straight silicon were left in two different conditions of low temperature low humidity (at 10° C. and 20%) and high temperature high humidity (at 30° C. and 85%), respectively for 8 hours or more. Then, 5 parts by weight of the electrophotographic toner and 95 parts by weight of the carrier were mixed in a plastic container, and stirred for 30 minutes by a tumbler, shaker or mixer. The charge quantity was measured by a suction type blow-off (TTB-200, manufactured by Kyocera Chemical Corporation). The charge quantity of the toner which had been left under the low temperature low humidity environment (hereinafter, referred to as "q/m [L/L]") was 35.0 (μC/g); and the charge quantity of the toner which had been left under the high temperature high humidity environment (hereinafter, referred to as "q/m [H/H]") was 28.1 (μC/g). The environmental variation rate was calculated as an index of the environmental stability of charge quantity according to the following expression. As a result, it was found to be 0.80. When the environmental variation rate is 0.80 or more, a satisfactory image can be obtained regardless of the environmental atmosphere.

$$\text{(Environmental Variation Rate)}=(q/m[H/H])/(q/m[L/L])$$

The electrophotographic toner was put into a multifunctional copier, e-Studio 281c manufactured by Toshiba Corporation, to give a test on 10,000 sheets. Thereafter, the charge quantity of the developing agent was measured with E-spart analyzer manufactured by Hosokawa Micron, Ltd. to examine an inverse charge quantity, which was 0.02%. Further, the background fog of an image was 0.56%. If the background fog is 1% or less, a satisfactory image could be obtained.

Example 1-2

The coarse product used in Example 1-1 was further pulverized to obtain a medium-sized pulverized particle with a volume average particle size of 168 μm.

40 parts by weight of the medium-sized pulverized particle, 4 parts by weight of sodium dodecylbenzene sulfonate as an anionic surfactant, 2 parts by weight of triethylamine as an amine compound, and 55 parts by weight of ion exchange water were pre-dispersed with Ultra-Turrax T50 manufactured IKA Japan K.K. to obtain a pre-dispersion 1.

The pre-dispersion 1 was put into Nanomizer manufactured by Yoshida Kikai Kogyo Co., Ltd., which was YSNM-2000 AR additionally having a heating system. After adjusting the heating system to 120° C., the pre-dispersion 1 was repeatedly treated three times under a pressure of 100 MPa of the Nanomizer. A coloring particle obtained by cooling down the pre-dispersion 1 had a volume average particle diameter of 4.8 μm when measured with SALD 7000 (manufactured by Shimadzu Corp.). This dispersion was defined as a dispersion 1.

30 parts by weight of styrene, 8 parts by weight of butyl acrylate, 2 parts by weight of an acrylic acid, 1 part by weight of dodecanethiol, and 0.4 parts by weight of sodium lauryl sulfate as an anionic surfactant were dispersed in 50 parts by weight of ion exchange water and the dispersion was emulsified in a flask. Then, the emulsified dispersion was heated to 70° C. under nitrogen atmosphere. When reached 70° C., a solution prepared by dissolving 0.1 parts by weight of ammonium persulfate in 8.5 parts by weight of ion exchange water was added thereto. After 5-hour reaction, a resin fine particle dispersion was obtained. The resin had a volume average particle diameter of 0.12 μm when measured with SALD 7000 (manufactured by Shimadzu Corp.). This dispersion was defined as a dispersion 2.

Then, 90 parts by weight of the dispersion 1, 9 parts by weight of the dispersion 2, and 1 part by weight of calcium sulfate were stirred at 6,000 rpm for 10 minutes using Ultra-Turrax T50 manufactured IKA Japan K.K. and heated to 60° C., and then kept for 1 hour. In this state, a sampling was taken and cooled down. As a result of examination by SEM, it was observed that the resin fine particle was deposited on the surface of the coloring particle. In order to maintain the volume average particle size of the coloring particle, 2 parts by weight of sodium dodecylbenzene sulfonate as a dispersant was added and heated to 90° C. and left for 3 hours to control the shape thereof.

The dispersion was washed by the same process as Example 1-1, and the washing process was completed when the conductivity of the waste liquid from washing was decreased to 161 μS/cm. The solid part was dried by a decompression drier to obtain a toner particle.

Thereafter, as an additive, 2 parts by weight hydrophobic silica and 0.5 parts by weight of titanium oxide were deposited on the surface of the toner particle to obtain an electrophotographic toner.

The electrophotographic toner had a volume average particle diameter of 4.9 μm when measured with a coulter counter manufactured by Beckman Coulter, Inc. and a circularity of 0.98 when measured with FPIA-2100 manufactured by Sysmex Corporation.

The electrophotographic toner obtained by the same process as Example 1-1 was evaluated, which had an amount of the remaining surfactant of 0.62%, an amount of the remaining basic compound of 0.48%, an environmental variation rate of 0.84, an inverse charge quantity of 0.01%, and a background fog of 0.44.

Example 1-3

The pre-dispersion 1 used in Example 1-2 was put in Nonomizer manufactured by Yoshida Kikai Kogyo Co., Ltd., which was YSNM-2000 AR additionally having a heating system. After adjusting the heating system to 160° C., the pre-dispersion 1 was repeatedly treated three times under a pressure of 160 MPa of the Nanomizer. The coloring particle obtained by cooling down the pre-dispersion 1 had a volume average particle diameter of 0.56 μm when measured with SALD 7000 (manufactured by Shimadzu Corp.)

While keeping the dispersion at 55° C., the coloring fine particle was coagulated by gently acidifying by adding hydrochloric acid until it had a desired volume average particle diameter, thereby obtaining a coloring particle. The obtained coloring particle had a volume average particle diameter of 4.2 μm when measured with a coulter counter manufactured by Beckman Coulter, Inc.

The dispersion was washed by the same process as Example 1-1, and the washing process was completed when the conductivity of the waste liquid from washing was decreased to 95 μS/cm. The solid part was dried by a decompression drier to obtain a toner particle.

Thereafter, as an additive, 2 parts by weight hydrophobic silica and 0.5 parts by weight of titanium oxide were deposited on the surface of the toner particle to obtain a desired electrophotographic toner.

The electrophotographic toner had a volume average particle diameter of 4.2 μm when measured with a coulter counter manufactured by Beckman Coulter, Inc. and a circularity of 0.98 when measured with FPIA-2100 manufactured by Sysmex Corporation.

The electrophotographic toner obtained by the same process as Example 1-1 was evaluated, which had an amount of the remaining surfactant of 0.12%, an amount of the remaining basic compound of 0.20%, an environmental variation rate of 0.87, an inverse charge quantity of 0.01%, and a background fog of 0.09.

Example 1-4

36 parts by weight of a polyester resin, 2 parts by weight of carbon black, 1.6 parts by weight of ester wax, 0.4 parts by weight of a charge controller, 4 parts by weight of an anionic surfactant, 1 part by weight of an amine compound, and 55 parts by weight of ion exchange water were put into Clearmix manufactured by Mtechnique Co., Ltd. After the temperature of the sample was increased to 120° C., the mixture in the Clearmix was stirred at a rotation speed of 6,000 rmp for 30 minutes. After completion of the mechanical shearing, some of the dispersion was taken and cooled down to normal temperature.

The coloring particle thus obtained had a volume average particle diameter of 0.49 μm when measured with SALD 7000 (manufactured by Shimadzu Corp.).

While keeping the dispersion at 55° C., the coloring fine particle was coagulated by gently adding a calcium sulfate aqueous solution until it had a desired volume average particle diameter, thereby obtaining a coloring particle.

The obtained coloring particle had a volume average particle diameter of 4.3 μm when measured with a coulter counter manufactured by Beckman Coulter, Inc.

Then, 90 parts by weight of the dispersion, 90 parts by weight of the dispersion 2 in Example 1-2, and 1 part by weight of calcium sulfate were stirred at 6,000 rpm for 10 minutes using Ultra-Turrax T50 manufactured IKA Japan K.K. and heated to 60° C., and then kept for 1 hour. In this state, a sampling was taken and cooled down. As a result of examination by SEM, it was observed that the resin fine particle was deposited on the surface of the coloring particle. In order to maintain the volume average particle size of the coloring particle, 2 parts by weight of sodium dodecylbenzene sulfonate as a dispersant was added and heated to 90° C. and left for 3 hours to control the shape thereof.

The dispersion was washed by the same process as Example 1-1, and the washing process was completed when the conductivity of the waste liquid from washing was decreased to 15 μS/cm. The solid part was dried by a decompression drier to obtain a toner particle.

Thereafter, as an additive, 2 parts by weight hydrophobic silica and 0.5 parts by weight of titanium oxide were deposited on the surface of the toner particle to obtain a desired electrophotographic toner.

The electrophotographic toner had a volume average particle diameter of 4.5 μm when measured with a coulter counter manufactured by Beckman Coulter, Inc. and a circularity of 0.91 when measured with FPIA-2100 manufactured by Sysmex Corporation.

The electrophotographic toner obtained by the same process as Example 1-1 was evaluated, which had an amount of the remaining surfactant of 0.005%, an amount of the remaining basic compound of 0.0012%, an environmental variation rate of 0.92, an inverse charge quantity of 0%, and a background fog of 0.03.

Comparative Example 1-1

An electrophotographic toner was prepared under the same conditions as Example 1-1 except that the washing process was completed when the conductivity of the waste liquid from washing was decreased to 208 μS/cm.

The electrophotographic toner obtained by the same process as Example 1-1 was evaluated, which had a volume average particle diameter of 4.5 μm, a circularity of 0.98, an amount of the remaining surfactant of 1.92%, an amount of the remaining basic compound of 1.02%, an environmental variation rate of 0.76, an inverse charge quantity of 0.15%, and a background fog of 1.36.

Comparative Example 1-2

An electrophotographic toner was prepared under the same conditions as Example 1-1 except that the washing process was completed when the conductivity of the waste liquid from washing was decreased to 299 μS/cm.

The electrophotographic toner obtained by the same process as Example 1-1 was evaluated, which had a volume average particle diameter of 4.5 μm, a circularity of 0.98, an amount of the remaining surfactant of 2.29%, an amount of the remaining basic compound of 1.45%, an environmental variation rate of 0.68, an inverse charge quantity of 0.26%, and a background fog of 1.52.

Comparative Example 1-3

An electrophotographic toner was prepared under the same conditions as Example 1-1 except that the washing process was completed when the conductivity of the waste liquid from washing was decreased to 211 μS/cm.

The electrophotographic toner obtained by the same process as Example 1-1 was evaluated, which had a volume average particle diameter of 4.5 μm, a circularity of 0.91, an amount of the remaining surfactant of 2.09%, an amount of the remaining basic compound of 0.98%, an environmental variation rate of 0.78, an inverse charge quantity of 0.18%, and a background fog of 1.43.

Comparative Example 1-4

An electrophotographic toner was prepared under the same conditions as Example 1-1 except that the washing process was completed when the conductivity of the waste liquid from washing was decreased to 309 μS/cm.

The electrophotographic toner obtained by the same process as Example 1-1 was evaluated, which had a volume average particle diameter of 4.5 μm, a circularity of 0.91, an amount of the remaining surfactant of 2.41%, an amount of the remaining basic compound of 1.65%, an environmental variation rate of 0.52, an inverse charge quantity of 0.84%, and a background fog of 1.76.

The obtained results was shown in the following Table 1.

TABLE 1

| | Final conductivity of water from washing | Remaining surfactant (ratio of solid part of toner) | Remaining basic compound (ratio of solid part of toner) | Environmental variation rate | Quantity of inverse charge toner | Fog |
|---|---|---|---|---|---|---|
| Example | 197 | 1.60 | 0.89 | 0.80 | 0.02 | 0.56 |
| Example | 161 | 0.62 | 0.48 | 0.84 | 0.01 | 0.44 |
| Example | 95 | 0.12 | 0.20 | 0.87 | 0 | 0.09 |
| Example | 15 | 0.0050 | 0.0012 | 0.92 | 0 | 0.03 |
| Comparative Example | 208 | 1.92 | 1.02 | 0.76 | 0.15 | 1.36 |

TABLE 1-continued

| | Final conductivity of water from washing | Remaining surfactant (ratio of solid part of toner) | Remaining basic compound (ratio of solid part of toner) | Environmental variation rate | Quantity of inverse charge toner | Fog |
|---|---|---|---|---|---|---|
| Comparative Example | 299 | 2.29 | 1.45 | 0.68 | 0.26 | 1.52 |
| Comparative Example | 211 | 2.09 | 0.98 | 0.78 | 0.18 | 1.43 |
| Comparative Example | 309 | 2.41 | 1.65 | 0.52 | 0.84 | 1.76 |

Since the invention is suitable for preparation of a coloring particle with a small-sized particle diameter, a particle obtained by the invention can be applicable for wet electrophotography as its dispersion besides being used as a powder.

As for a preparation method of a toner which can be adjustable in the diameter and shape of a particle, a new method which is not restricted by the kind of resin and uses an aqueous medium not involved in collection of a solvent is proposed. However, a satisfactory fixing property or transfer efficiency grows by regulating the amount of a surfactant remaining in the toner and the basic compound, and thus an excellent charge characteristic is obtained regardless of environmental atmosphere and the quantity of an inverse-charge toner in the distribution of the charge quantity is reduced so that an image less fogged can be obtained.

Example 2-1

90 parts by weight of a polyester resin (acid value: 9, glass transition temperature: 61° C.) as a binder resin, 5 parts by weight of a cyan pigment (copper phthalocyanine) as a coloring agent, 4 parts by weight of ester wax, and 1 part by weight of a zirconia metal complex as a charge controller were mixed and then melt-kneaded in a biaxial kneader at 120° C. to obtain a kneaded mixture.

The kneaded mixture was pulverized with a hammermill manufactured by Nara Machine Manufacturing Co., Ltd. to obtain a coarse particle having a volume average particle size of 1.2 mm.

Further, the coarse particle was put into a bantam mill manufactured by Hosokawa Micron, Ltd. and pulverized at a rotation speed of 12,000 rpm to obtain a medium-sized pulverized particle. The obtained particle had a volume average particle diameter of 59.3 μm when measured with SALD 7000 (manufactured by Shimadzu Corp.).

40 parts by weight of the medium-sized pulverized particle, 2 parts by weight of sodium dodecylbenzene sulfonate as a dispersant, 2 parts by weight of sodium salt of an acrylic acid and a maleic acid copolymer, 2 parts by weight of triethylamine as a dispersion aid, and 55 parts by weight of ion exchange water were pre-dispersed with Ultra-Turrax T50 manufactured IKA Japan K.K. to obtain a pre-dispersion.

The pre-dispersion was put into Nanomizer (manufactured by Yoshida Kikai Kogyo Co., Ltd.), which was YSNM-2000 AR additionally having a heating system. After adjusting the heating system to 160° C., the pre-dispersion was repeatedly treated three times under a pressure of 160 MPa of the Nanomizer. A coloring particle obtained by cooling down the pre-dispersion had a volume average particle diameter of 0.42 μm when measured with SALD 7000 (manufactured by Shimadzu Corp.). While keeping the dispersion at 40° C., 2 parts by weight of aluminum sulfate was added and heated to 55° C., and the coloring fine particle was coagulated until it had a desired volume average particle diameter, thereby obtaining a coagulated particle dispersion. Then, 4 parts by weight of sodium salt of an acrylic acid and a maleic acid copolymer as a dispersion stabilizer was added, heated to 90° C., and left for 3 hours to obtain a fused particle dispersion.

The fused particle dispersion was separated into the solid part and the liquid part and washed with 600 ml of ion exchange water. When completion of washing, the conductivity of the waste liquid from washing was measured by ES-51 conductivity meter (manufactured by Horiba, Ltd.), which was 76 μS/cm. Then, the obtained solid part was dried with a vacuum drier to obtain a dry particle.

As an additive, 2 parts by weight of a hydrophobic silica and 1 part by weight of titanium oxide were deposited on 100 parts by weight of the toner particle and passed through a 75 μm-mesh sieve to obtain a desired electrophotographic toner. The weight of the remaining coarse powder on the sieve was 0.1% by weight relative to the total weight of the toner particle. If the coarse powder was 2% by weight or more, a large amount of particles with a size of 10 μm or more existed among the toner having passed through the sieve. As a result, an image was liable to be remarkably deteriorated.

The obtained electrophotographic toner had a volume average particle diameter of 5.5 μm when measured with a coulter counter manufactured by Beckman Coulter, Inc. and a circularity of 0.96 when measured with FPIA-2100 manufactured by Sysmex Corporation.

Method of Measurement of Content of Remaining Surfactant

With the same method as Example 1-1, the amount of the remaining sulfone-based surfactant and the amount of the remaining polycaboxilic acid-based surfactant in the obtained electrophotographic toner were measured and evaluated.

Figure 4:
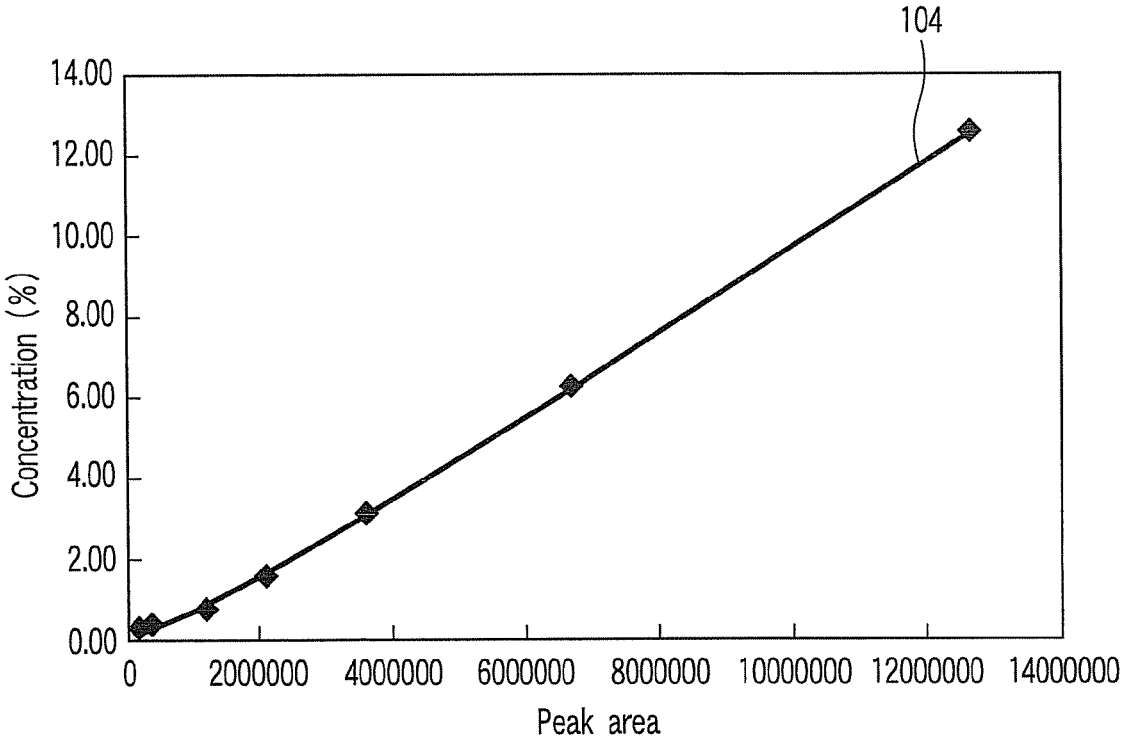
FIG. 4 is a graph illustrating an example of a calibration curve to detect the amount of the remaining polycarboxylic acid-based surfactant.

The obtained curves were shown, respectively by graphs 103 and 104 in FIG. 1 and FIG. 4.

2 g of the electrophotographic toner and 20 g of ion exchange water were mixed and ultrasonically-dispersed for 60 minutes. The obtained dispersion was separated by a filter into a solid part and a liquid part. The filtrate was taken with HPLC to detect the sulfonate-based surfactant and the polycarboxylic acid-based surfactant. From the calibration curve, the amount of the remaining sulfonate-based surfactant and the amount of the remaining polycarboxylic acid-based surfactant were analyzed, which were 0.24% by weight and 2.52% by weight, respectively.

Evaluation of Environmental Variation Rate

The charge quantity was measured by the same method as Example 1-1 in different conditions using the obtained electrophotographic toner and a ferrite carrier coated with straight silicon. The environmental variation rate was calculated as an index of the environmental stability of charge quantity according to the foregoing expression. As a result, it was found to be 0.84. When the environmental variation rate is 0.80 or more, a satisfactory image can be obtained regardless of the environmental atmosphere.

Image Quality

The electrophotographic toner was put into a multifunctional copier, e-Studio 281c manufactured by Toshiba Corporation, to give a test on 10,000 sheets of paper, which was evaluated as follows. Further, the image was formed in a predetermined print pattern at a printing efficiency of 5%.

After making 10,000 copies (life end), the image quality was checked out with the naked eye.

The image was satisfactory. (Hereinafter, the evaluation of an image was made on the basis of the following standards.)

The standards were as follows.

○: Satisfactory

Δ: Slightly deteriorated than ○ but not distinguishable

X: Distinguishably deteriorated than ○

Transfer Efficiency

On the prints made 200 copies, the transfer efficiency was calculated from the remaining transfer quantity, the inverse transfer quantity, and the weight variation of the paper, which was 97.5%.

Example 2-2

40 parts by weight of the coarse particle used in Example 1-5, 2 parts by weight of sodium dodecylbenzene sulfonate as a dispersant, 2 parts by weight of sodium salt of acrylic acid and a maleic acid copolymer, 2 parts by weight of triethylamine as a dispersion aid, and 55 parts by weight of ion exchange water were put into Clearmix manufactured by Mtechnique Co., Ltd. After the temperature of the sample was increased to 120° C., the mixture in the Clearmix was stirred at a rotation speed of 10,000 rmp for 30 minutes. After completion of the mechanical shearing, some of the dispersion was taken and cooled down to normal temperature.

The coloring particle thus obtained had a volume average particle diameter of 0.49 μm when measured with SALD 7000 (manufactured by Shimadzu Corp.).

While keeping the dispersion at 55° C., the coloring fine particle was coagulated by gently adding a calcium sulfate aqueous solution until it had a desired volume average particle diameter, thereby obtaining a coagulated particle dispersion 1'.

The obtained coagulated particle had a volume average particle diameter of 4.3 μm when measured with a coulter counter manufactured by Beckman Coulter, Inc.

30 parts by weight of styrene, 8 parts by weight of butyl acrylate, 2 parts by weight of an acrylic acid, 1 part by weight of dodecanethiol, and 0.4 parts by weight of sodium lauryl sulfate as a dispersant were dispersed in 50 parts by weight of ion exchange water and the dispersion was emulsified in a flask. Then, the emulsified dispersion was intactly heated to 70° C. under nitrogen atmosphere. A solution prepared by dissolving 0.1 parts by weight ammonium persulfate in 8.5 parts by weight of ion exchange water was added thereto at 70° C. After 5-hour reaction, a resin fine particle dispersion was obtained. The resin had a volume average particle diameter of 0.12 μm when measured with SALD 7000 (manufactured by Shimadzu Corp.) This dispersion was defined as a dispersion 2'.

Then, 90 parts by weight of the coagulated particle dispersion 1', 9 parts by weight of the dispersion 2', and 1 part by weight of calcium sulfate were stirred at 6,000 rpm for 10 minutes using Ultra-Turrax T50 manufactured IKA Japan K.K. and heated to 60° C., and then kept for 1 hour. In this state, a sampling was taken and cooled down. As a result of examination by SEM, it was observed that the resin fine particle was deposited on the surface of the coloring particle. Then, 4 parts by weight of sodium salt of an acrylic acid and a maleic acid copolymer as a dispersion stabilizer was added, heated to 90° C., and left for 3 hours to obtain a fused particle dispersion.

The fused particle dispersion was separated into a solid part and a liquid part and washed with 600 ml of ion exchange water. When completion of washing, the conductivity of the waste liquid from washing was measured by ES-51 conductivity meter (manufactured by Horiba, Ltd.), which was 154 μS/cm. Then, the obtained solid part was dried with a vacuum drier to obtain a dry particle.

As an additive, 2 parts by weight of a hydrophobic silica and 1 part by weight of titanium oxide were deposited on 100 parts by weight of the toner particle and passed through a 75 μm-mesh sieve to obtain a desired electrophotographic toner. The remaining coarse powder on the sieve was 0.2% by weight.

The obtained electrophotographic toner had a volume average particle diameter of 4.6 μm when measured with a coulter counter manufactured by Beckman Coulter, Inc. and a circularity of 0.97 when measured with FPIA-2100 manufactured by Sysmex Corporation.

The electrophotographic toner obtained by the same process as Example 2-1 was evaluated, which had an amount of the remaining sulfone-based surfactant of 0.30%, an amount of the remaining polycarboxilic acid-based surfactant of 2.88%, q/m (L/L) of −30.3 (μC/g), q/m (H/H) of −24.3 (μC/g), an environmental variation rate of 0.80, an image quality of ○, and a transfer efficiency of 97.1%.

Example 2-3

79.6 parts by weight of styrene, 10 parts by weight of butyl acrylate, and 4 parts by weight of an acrylic acid were mixed to obtain a mixture solution.

2 parts by weight of sodium dodecylbenzene sulfonate, 2 parts by weight of sodium salt of an acrylic acid and a maleic acid copolymer, and 200 parts by weight of ion exchange water were added to 40 parts by weight of the mixture solution, dispersed, and emulsified. 20 parts by weight of ion exchange water where 2 parts by weight of ammonium persulfate was dissolved was added thereto to be displaced with nitrogen. Then, the resulting product was heated to 70° C. while being stirred and continued emulsion-polymerizing for 5 hours, thereby preparing a resin dispersion.

20 parts by weight of carbon black, 2 parts by weight of an anionic surfactant, and 78 parts by weight of ion exchange water were mixed and stirred at 6,000 rpm for 10 minutes using Ultra-Turrax T50 manufactured IKA Japan K.K., thereby preparing a pigment dispersion.

20 parts of ester wax, 2 parts by weight of an anionic surfactant, and 78 parts by weight of ion exchange water were mixed and heated to 95° C., and then were stirred at 6,000 rpm for 10 minutes using Ultra-Turrax T50 manufactured IKA Japan K.K. to be dispersed. The pre-dispersion was put into Nanomizer (manufactured by Yoshida Kikai Kogyo Co., Ltd., which was YSNM-2000 AR additionally having a heating system). After adjusting the heating system to 160° C., the pre-dispersion was repeatedly treated three times under a pressure of 100 MPa of the Nanomizer to prepare a wax dispersion.

66 parts by weight of the resin dispersion, 17 parts by weight of the pigment dispersion, and 17 parts by weight of the wax dispersion were dispersed with Ultra-Turrax T50 manufactured IKA Japan K.K. While keeping the dispersion at 55° C., the coloring fine particle was coagulated by gently adding a hydrochloric acid to slowly acidify until it had a desired volume average particle diameter, thereby obtaining a coagulated particle dispersion. Then, 1.5 parts by weight of sodium salt of an acrylic acid and a maleic acid copolymer as a dispersion stabilizer was added, heated to 90° C., and left for 3 hours to obtain a fused particle dispersion.

The fused particle dispersion was separated into a solid part and a liquid part and washed with 600 ml of ion exchange water. When completion of washing, the conductivity of the waste liquid from washing was measured by ES-51 conductivity meter (manufactured by Horiba, Ltd.), which was 175 μS/cm. Then, the obtained solid part was dried with a vacuum drier to obtain a dry particle.

As an additive, 2 parts by weight of hydrophobic silica and 1 part by weight of titanium oxide were deposited on 100 parts by weight of the toner particle and passed through a 75 μm-mesh sieve to obtain a desired electrophotographic toner. The remaining coarse powder on the sieve was 0.4% by weight.

The obtained electrophotographic toner had a volume average particle diameter of 5.2 μm when measured with a coulter counter manufactured by Beckman Coulter, Inc. and a circularity of 0.98 when measured with FPIA-2100 manufactured by Sysmex Corporation.

The electrophotographic toner obtained by the same process as Example 2-1 was evaluated, which had an amount of the remaining sulfone-based surfactant of 0.35% by weight, an amount of the remaining polycarboxilic acid-based surfactant of 4.28% by weight, q/m (L/L) of −28.1 (μC/g), q/m (H/H) of −22.5 (μC/g), an environmental variation rate of 0.81, an image quality of ○, and a transfer efficiency of 98.5%.

Example 2-4

A fused particle dispersion was prepared under the same conditions as Example 2-1 except that 40 parts by weight of the medium-sized pulverized particle mentioned in Example 2-1, 2.5 parts by weight of sodium lauryl sulfate as a dispersant, 1.5 parts by weight of sodium polyacrylate, 2 parts by weight of triethylamine as a dispersion aid, and 55 parts by weight of ion exchange water were pre-dispersed with Ultra-Turrax T50 manufactured IKA Japan K.K. to obtain a pre-dispersion.

The fused particle dispersion was separated into a solid part and a liquid part and washed with 600 ml of ion exchange water. When completion of washing, the conductivity of the waste liquid from washing was measured by ES-51 conductivity meter (manufactured by Horiba, Ltd.), which was 90 μS/cm. Then, the obtained solid part was dried with a vacuum drier to obtain a dry particle.

As an additive, 2 parts by weight of hydrophobic silica and 1 part by weight of titanium oxide were deposited on 100 parts by weight of the toner particle and passed through a 75 μm-mesh sieve to obtain a desired electrophotographic toner. The remaining coarse powder on the sieve was 0.3% by weight.

The obtained electrophotographic toner had a volume average particle diameter of 5.8 μm when measured with a coulter counter manufactured by Beckman Coulter, Inc. and a circularity of 0.97 when measured with FPIA-2100 manufactured by Sysmex Corporation.

The electrophotographic toner obtained by the same process as Example 2-1 was evaluated, which had an amount of the remaining sulfone-based surfactant of 0.45% by weight, an amount of the remaining polycarboxilic acid-based surfactant of 2.43% by weight, q/m (L/L) of −31.0 (μC/g), q/m (H/H) of −25.7 (μC/g), an environmental variation rate of 0.83, an image quality of ○, and a transfer efficiency of 97.6%.

Example 2-5

30 parts by weight of styrene, 8 parts, by weight of butyl acrylate, 2 parts by weight of an acrylic acid, 1 part by weight of dodecanethiol, and 0.5 parts by weight of an alkyldiphenyletherdisulfonic acid as a dispersant were dispersed in 50 parts by weight of ion exchange water, and the dispersion was emulsified in a flask. Then, the emulsified dispersion was intactly heated to 70° C. under nitrogen atmosphere. A solution prepared by dissolving 0.1 parts by weight of ammonium persulfate in 8.5 parts by weight of ion exchange water was added thereto at 70° C. After 5-hour reaction, a resin fine particle dispersion was obtained. A fused particle dispersion was prepared under the same conditions as Example 2-3 except that the abovementioned process was carried out.

The fused particle dispersion was separated into a solid part and a liquid part and washed with 600 ml of ion exchange water. When completion of washing, the conductivity of the waste liquid from washing was measured by ES-51 conductivity meter (manufactured by Horiba, Ltd.), which was 115 μS/cm. Then, the obtained solid part was dried with a vacuum drier to obtain a dry particle.

As an additive, 2 parts by weight of hydrophobic silica and 1 part by weight of titanium oxide were deposited on 100 parts by weight of the toner particle and passed through a 75 μm-mesh sieve to obtain a desired electrophotographic toner. The remaining coarse powder on the sieve was 1.1% by weight.

The obtained electrophotographic toner had a volume average particle diameter of 5.7 μm when measured with a coulter counter manufactured by Beckman Coulter, Inc. and a circularity of 0.98 when measured with FPIA-2100 manufactured by Sysmex Corporation.

The electrophotographic toner obtained by the same process as Example 2-1 was evaluated, which had an amount of the remaining sulfone-based surfactant of 0.21% by weight, an amount of the remaining polycarboxilic acid-based surfactant of 4.34% by weight, q/m (L/L) of −29.2 (μC/g), q/m (H/H) of −24.9 (μC/g), an environmental variation rate of 0.80, an image quality of ○, and a transfer efficiency of 98.1%.

Example 2-6

A fused particle dispersion was prepared under the same conditions as Example 2-1 except that 40 parts by weight of the medium-sized pulverized particle mentioned in Example 2-1, 1.5 parts by weight of sodium dodecylbenzene sulfonate as a dispersant, 2.5 parts by weight of a copolymer of acrylate and ester, 2 parts by weight of triethylamine as a dispersion aid, and 55 parts by weight of ion exchange water were pre-dispersed with Ultra-Turrax T50 manufactured IKA Japan K.K. to obtain a pre-dispersion.

The fused particle dispersion was separated into a solid part and a liquid part and washed with 600 ml of ion exchange water. When completion of washing, the conductivity of the waste liquid from washing was measured by ES-51 conductivity meter (manufactured by Horiba, Ltd.), which was 173 μS/cm. Then, the obtained solid part was dried with a vacuum drier to obtain a dry particle.

As an additive, 2 parts by weight of hydrophobic silica and 1 part by weight of titanium oxide were deposited on 100 parts by weight of the toner particle and passed through a 75 μm-mesh sieve to obtain a desired electrophotographic toner. The remaining coarse powder on the sieve was 1.6% by weight.

The obtained electrophotographic toner had a volume average particle diameter of 5.1 μm when measured with a coulter counter manufactured by Beckman Coulter, Inc. and a circularity of 0.97 when measured with FPIA-2100 manufactured by Sysmex Corporation.

The electrophotographic toner obtained by the same process as Example 2-1 was evaluated, which had an amount of the remaining sulfone-based surfactant of 0.11% by weight, an amount of the remaining polycarboxilic acid-based surfactant of 4.74% by weight, q/m (L/L) of −31.3 (μC/g), q/m (H/H) of −26.2 (μC/g), an environmental variation rate of 0.84, an image quality of ○, and a transfer efficiency of 96.7%.

Comparative Example 2-1

An electrophotographic toner was prepared under the same conditions as Example 2-1 except that the fused particle dispersion was separated into a solid part and a liquid part and washed with 400 ml of ion exchange water; and the obtained solid part was dried with a vacuum drier to obtain a dry particle. When completion of washing, the waste liquid from washing had a conductivity of 280 μS/cm. After depositing an additive on the dry particle and passing the resulting particle through a sieve, the remaining coarse powder on the sieve was 0.3% by weight.

The obtained electrophotographic toner had a volume average particle diameter of 5.7 μm when measured with a coulter counter manufactured by Beckman Coulter, Inc. and a circularity of 0.97 when measured with FPIA-2100 manufactured by Sysmex Corporation.

The electrophotographic toner obtained by the same process as Example 2-1 was evaluated, which had an amount of the remaining sulfone-based surfactant of 0.52% by weight, an amount of the remaining polycarboxilic acid-based surfactant of 3.28% by weight, q/m (L/L) of −10.1 (μC/g), q/m (H/H) of −6.5 (μC/g), an environmental variation rate of 0.64, an image quality of Δ, and a transfer efficiency of 93.5%.

Comparative Example 2-2

An electrophotographic toner was prepared under the same conditions as Example 2-1 except that 40 parts by weight of the medium-sized pulverized particle mentioned in Example 2-1, 1 part by weight of sodium dodecylbenzene sulfonate as a dispersant, 6 parts by weight of sodium salt of an acrylic acid and a maleic acid copolymer, 2 parts by weight of triethylamine as a dispersion aid, and 55 parts by weight of ion exchange water were pre-dispersed with Ultra-Turrax T50 manufactured IKA Japan K.K. to obtain a pre-dispersion. When completion of washing, the waste liquid from washing had a conductivity of 236 μS/cm. After depositing an additive on the dry particle and passing the resulting particle through a sieve, the remaining coarse powder on the sieve was 6.7 parts by weight.

The obtained electrophotographic toner had a volume average particle diameter of 6.2 μm when measured with a coulter counter manufactured by Beckman Coulter, Inc. and a circularity of 0.96 when measured with FPIA-2100 manufactured by Sysmex Corporation.

The electrophotographic toner obtained by the same process as Example 2-1 was evaluated, which had an amount of the remaining sulfone-based surfactant of 0.09%, an amount of the remaining polycarboxilic acid-based surfactant of 7.38%, q/m (L/L) of −33.2 (μC/g), q/m (H/H) of −26.8 (μC/g), an environmental variation rate of 0.81, an image quality of X, and a transfer efficiency of 97.3%.

Comparative Example 2-3

An electrophotographic toner was prepared under the same conditions as Example 2-1 except that the fused particle dispersion was separated into a solid part and a liquid part and washed with 400 ml of ion exchange water; and the obtained solid part was dried with a vacuum drier to obtain a dry particle. When completion of washing, the waste liquid from washing had a conductivity of 36 μS/cm. After depositing an additive on the dry particle and passing the resulting particle through a sieve, the remaining coarse powder on the sieve was 0.1 parts by weight.

The obtained electrophotographic toner had a volume average particle diameter of 5.4 μm when measured with a coulter counter manufactured by Beckman Coulter, Inc. and a circularity of 0.96 when measured with FPIA-2100 manufactured by Sysmex Corporation.

The electrophotographic toner obtained by the same process as Example 2-1 was evaluated, which had an amount of the remaining sulfone-based surfactant of 0.03%, an amount of the remaining polycarboxilic acid-based surfactant of 0.09%, q/m (L/L) of −17.5 (μC/g), q/m (H/H) of −12.3 (μC/g), an environmental variation rate of 0.70, an image quality of Δ, and a transfer efficiency of 95.2%.

Comparative Example 2-4

An electrophotographic toner was prepared under the same conditions as Example 2-2 except that the fused particle dispersion was separated into a solid part and a liquid part and washed with 400 ml of ion exchange water; and the obtained solid part was dried with a vacuum drier to obtain a dry particle. When completion of washing, the waste liquid from washing had a conductivity of 365 μS/cm. After depositing an additive on the dry particle and passing the resulting particle through a sieve, the remaining coarse powder on the sieve was 0.2 parts by weight.

The obtained electrophotographic toner had a volume average particle diameter of 4.7 μm when measured with a coulter counter manufactured by Beckman Coulter, Inc. and a circularity of 0.97 when measured with FPIA-2100 manufactured by Sysmex Corporation.

The electrophotographic toner obtained by the same process as Example 2-1 was evaluated, which had an amount of the remaining sulfone-based surfactant of 0.66%, an amount of the remaining polycarboxilic acid-based surfactant of 4.88%, q/m (L/L) of −8.3 (μC/g), q/m (H/H) of −5.1 (μC/g), an environmental variation rate of 0.61, an image quality of Δ, and a transfer efficiency of 92.1%.

Comparative Example 2-5

An electrophotographic toner was prepared under the same conditions as Example 2-3 except that the fused particle dispersion was separated into a solid part and a liquid part and washed with 400 ml of ion exchange water; and the obtained solid part was dried with a vacuum drier to obtain a dry particle. When completion of washing, the waste liquid from washing had a conductivity of 383 μS/cm. After depositing an additive on the dry particle and passing the resulting particle through a sieve, the remaining coarse powder on the sieve was 5.3 parts by weight.

The obtained electrophotographic toner had a volume average particle diameter of 6.1 μm when measured with a coulter counter manufactured by Beckman Coulter, Inc. and a circularity of 0.98 when measured with FPIA-2100 manufactured by Sysmex Corporation.

The electrophotographic toner obtained by the same process as Example 2-1 was evaluated, which had an amount of the remaining sulfone-based surfactant of 0.55%, an amount of the remaining polycarboxilic acid-based surfactant of 5.41%, q/m (L/L) of −7.9 (μC/g), q/m (H/H) of −3.6 (μC/g), an environmental variation rate of 0.46, an image quality of X, and a transfer efficiency of 91.5%.

The obtained results were shown in Table 2, and Table 3.

TABLE 2

| | | Conductivity of waste liquid from washing (μS/cm) | Volume average particle size of toner | Circularity | Amount of coarse powder (part by weight) | Remaining sulfonic acid-based surfactant (wt %) | Remaining carboxylic acid-based surfactant (wt %) |
|---|---|---|---|---|---|---|---|
| Example | 2-1 | 76 | 5.5 | 0.96 | 0.1 | 0.24 | 2.52 |
| | 2-2 | 154 | 4.6 | 0.97 | 0.2 | 0.30 | 2.88 |
| | 2-3 | 174 | 5.2 | 0.98 | 0.4 | 0.35 | 4.28 |
| | 2-4 | 90 | 5.8 | 0.97 | 0.3 | 0.45 | 2.43 |
| | 2-5 | 115 | 5.7 | 0.98 | 1.1 | 0.21 | 4.34 |
| | 2-6 | 173 | 5.1 | 0.97 | 1.6 | 0.11 | 4.74 |
| Comparative Example | 2-1 | 280 | 5.7 | 0.97 | 0.3 | 0.52 | 3.28 |
| | 2-2 | 236 | 6.2 | 0.96 | 6.7 | 0.09 | 7.38 |
| | 2-3 | 36 | 5.4 | 0.96 | 0.1 | 0.03 | 0.09 |
| | 2-4 | 365 | 4.7 | 0.97 | 0.2 | 0.66 | 4.88 |
| | 2-5 | 383 | 6.1 | 0.98 | 5.3 | 0.55 | 5.41 |

TABLE 3

| | | q/m(L/L), (μC/g) | q/m(H/H), (μC/g) | Environmental Variation rate | Image quality | Transfer efficiency |
|---|---|---|---|---|---|---|
| Example | 2-1 | −32.0 | −27.0 | 0.84 | ○ | 97.5 |
| | 2-2 | −30.3 | −24.3 | 0.80 | ○ | 97.1 |
| | 2-3 | −28.1 | −22.5 | 0.81 | ○ | 98.5 |
| | 2-4 | −31.0 | −25.7 | 0.83 | ○ | 97.6 |
| | 2-5 | −29.2 | −24.9 | 0.80 | ○ | 98.1 |
| | 2-6 | −31.3 | −26.2 | 0.84 | ○ | 96.7 |
| Comparative Example | 2-1 | −10.1 | −6.5 | 0.64 | Δ | 93.5 |
| | 2-2 | −33.2 | −26.8 | 0.81 | X | 97.3 |
| | 2-3 | −17.5 | −12.3 | 0.70 | Δ | 95.2 |
| | 2-4 | −8.3 | −5.1 | 0.61 | Δ | 92.1 |
| | 2-5 | −7.9 | −3.6 | 0.46 | X | 91.5 |

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A developing agent comprising:

a toner particle containing a fine particle containing at least a binder resin and a coloring agent, the fine particle obtained by melt kneading and pulverizing a mixture containing the binder resin and the coloring agent to form a granular mixed compound, and carrying out mechanical shearing on a dispersion including an aqueous medium, the granular mixed compound of a binder resin and a coloring agent dispersed in the aqueous medium, and at least one of a surfactant and a basic compound, wherein the content of the remaining basic compound is from 0 to 1% by weight and the content of the remaining surfactant is from 0 to 2% by weight relative to the total amount of the developing agent.

2. The developing agent according to claim 1, wherein the surfactant is an anionic surfactant.

3. The developing agent according to claim 1, wherein the basic compound is an amine compound.

4. The developing agent according to claim 1, wherein the fine particle is further coagulated to obtain a coagulated particle.

5. The developing agent according to claim 1, wherein the fine particle or a coagulated particle is provided with a coating layer on the surface thereof by adding and additional fine particle and hetero-coagulation.

6. The developing agent according to claim 5, wherein the additional fine particle comprises a resin component.

7. The developing agent according to claim 1, wherein after the mechanical shearing, the obtained fine particle is repeatedly washed until a waste liquid from washing gives a conductivity of 200 μS/cm or less.

8. A developing agent comprising:

a toner particle comprising a fine particle obtained by carrying out mechanical shearing on the dispersion including a solvent, a granular mixed compound comprising a pulverized particle of a kneaded product containing a binder resin and a coloring agent dispersed in the solvent, a sulfone-based surfactant, and a polycarboxylic acid-based surfactant, wherein the content of the remaining sulfone-based surfactant is from 0 to 0.5% by weight and the content of the remaining polycarboxylic acid-based surfactant is from 0.1 to 5% by weight relative to the total weight of the toner particle.

9. The developing agent according to claim 8, wherein the granular mixed compound further comprises a basic compound.

10. The developing agent according to claim 8, wherein the basic compound is an amine compound.

11. The developing agent according to claim 8, wherein the fine particle is further coagulated to obtain a coagulated particle.

12. The developing agent according to claim 8, wherein the granular mixed compound comprises a resin particle containing the binder resin and a coloring agent particle containing the coloring agent, and the toner particle comprises a coagulated particle obtained by coagulating the particles in the dispersion.

13. The developing agent according to claim 8, wherein the sulfone-based surfactant is at least one selected from the group consisting of alkyl sulphate, alkyl benzene sulfonate, alkyl naphthalene sulfonate, alkyl diphenyl disulfonate, alkyl diphenyl ether disulfonate, polyoxylene adduct alkyl sulphate, dialkyl sulfosuccinate, naphthaline sulfonate formalin condensate, phenolsulfonic acid formalin condensate, and polystyrene sulfonate.

14. The developing agent according to claim 8, wherein the polycarboxylic acid-based surfactant is at least one selected from the group consisting of polyacrylate, copolymer salt of .alpha.-olefin and maleic acid, and a copolymer of acrylate and ester.

15. The developing agent according to claim 8, wherein the fine particle or a coagulated particle is provided with a coating layer on the surface thereof by adding an additional fine particle and allowing hetero-coagulation.

16. The developing agent according to claim 15, wherein the additional fine particle comprises a resin component.

17. The developing agent according to claim 8, wherein the granular mixed compound is obtained by melt-kneading and pulverizing a compound containing the binder resin and the coloring agent.

18. The developing agent according to claim 17, wherein after mechanical shearing, the obtained fine particle is repeatedly washed until a waste liquid from washing gives a conductivity of 200 μS/cm or less.

* * * * *